US009554603B2

(12) United States Patent
McCourt

(10) Patent No.: US 9,554,603 B2
(45) Date of Patent: Jan. 31, 2017

(54) GLOVE WITH REMOVABLE FINGERTIPS

(71) Applicant: 5.11, Inc., Irvine, CA (US)

(72) Inventor: Michael McCourt, Acworth, GA (US)

(73) Assignee: 5.11, INC., Irvine, CA (US)

( * ) Notice: Subject to any disclaimer, the term of this patent is extended or adjusted under 35 U.S.C. 154(b) by 145 days.

(21) Appl. No.: 14/542,208

(22) Filed: Nov. 14, 2014

(65) Prior Publication Data

US 2015/0135402 A1 May 21, 2015

Related U.S. Application Data

(60) Provisional application No. 61/904,743, filed on Nov. 15, 2013.

(51) Int. Cl.
*A41D 19/015* (2006.01)
*A41D 19/00* (2006.01)
*A41D 19/04* (2006.01)

(52) U.S. Cl.
CPC ..... *A41D 19/01576* (2013.01); *A41D 19/00* (2013.01); *A41D 19/04* (2013.01)

(58) Field of Classification Search
CPC ..... A41D 19/00; A63B 71/148; A61B 19/04
USPC ..... 2/163, 159, 161.1, 167, 169
See application file for complete search history.

(56) References Cited

U.S. PATENT DOCUMENTS 199,738 A * 1/1878 Parker ..... A41D 19/00 2/163
527,704 A * 10/1894 Merrill ..... A41D 19/00 2/163
4,131,952 A * 1/1979 Brenning, Jr. ..... A41D 19/015 2/124
4,507,807 A * 4/1985 Karkanen ..... A41D 19/0055 2/161.8
9,072,326 B2 * 7/2015 Becker ..... A41D 19/01505

* cited by examiner

*Primary Examiner* — Tejash Patel
(74) *Attorney, Agent, or Firm* — Kilpatrick Townsend & Stockton LLP

(57) ABSTRACT

A glove, having a finger sheath comprising multiple pieces of fabric held together by seams; and reinforcements for the seams so that part of the sheath can be removed by cutting without the seams unraveling.

17 Claims, 2 Drawing Sheets

GLOVE WITH REMOVABLE FINGERTIPS

CROSS-REFERENCE TO RELATED APPLICATION

This application is a Non-Provisional claiming priority from and the benefit of U.S. Provisional Application No. 61/904,743, filed Nov. 15, 2013, the content of which is incorporated herein by reference in its entirety.

BACKGROUND

Gloves protect and comfort hands against cold or heat, damage by friction, abrasion or chemicals, and disease. As an example, gloves are worn to protect the wearer's hands against rugged conditions, such as outdoor activities.

Very often, a wearer will desire to wear gloves, but have the tips of the fingers exposed for maximum dexterity. To remove the covers on some or all of the fingers, some wearers often cut all or a portion of the finger sheathes off of their gloves. However, this cutting can result in fraying or accidental dismantling of the glove.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments herein are directed to a glove with fingertips that can be removed. A nonwoven or leather material is provided on the back of the hand and up to a location to where a fingertip can be cut. In addition, reinforced stitching is provided on the inside of the glove finger or thumb sheathes to prevent fraying of the stitching of the sheathes after the sheathes have been cut.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Figure 2:
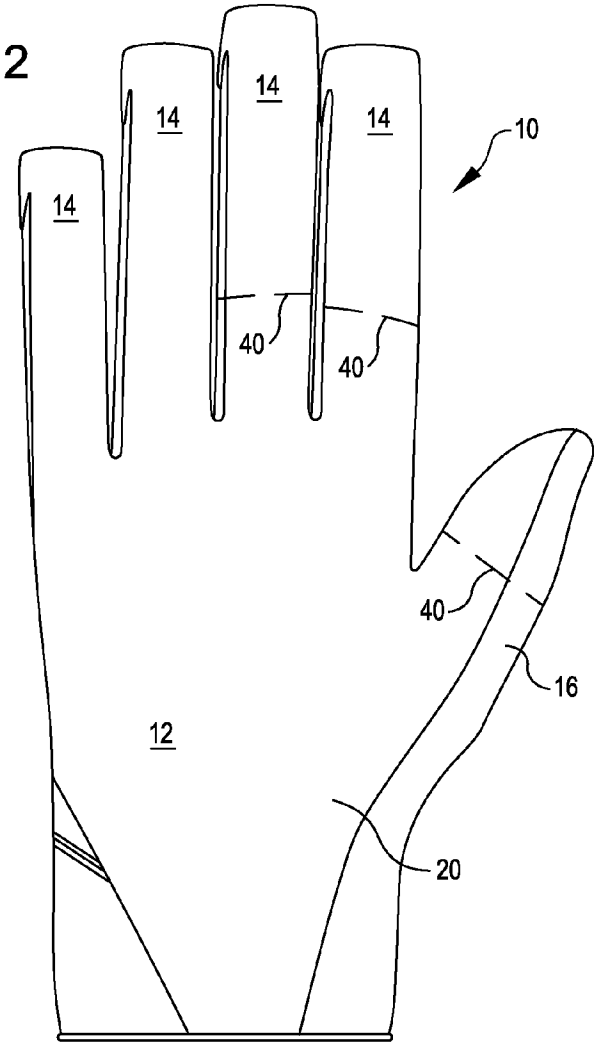
FIG. 2 is a rear, palm side view of the glove of FIG. 1.
Figure 1:
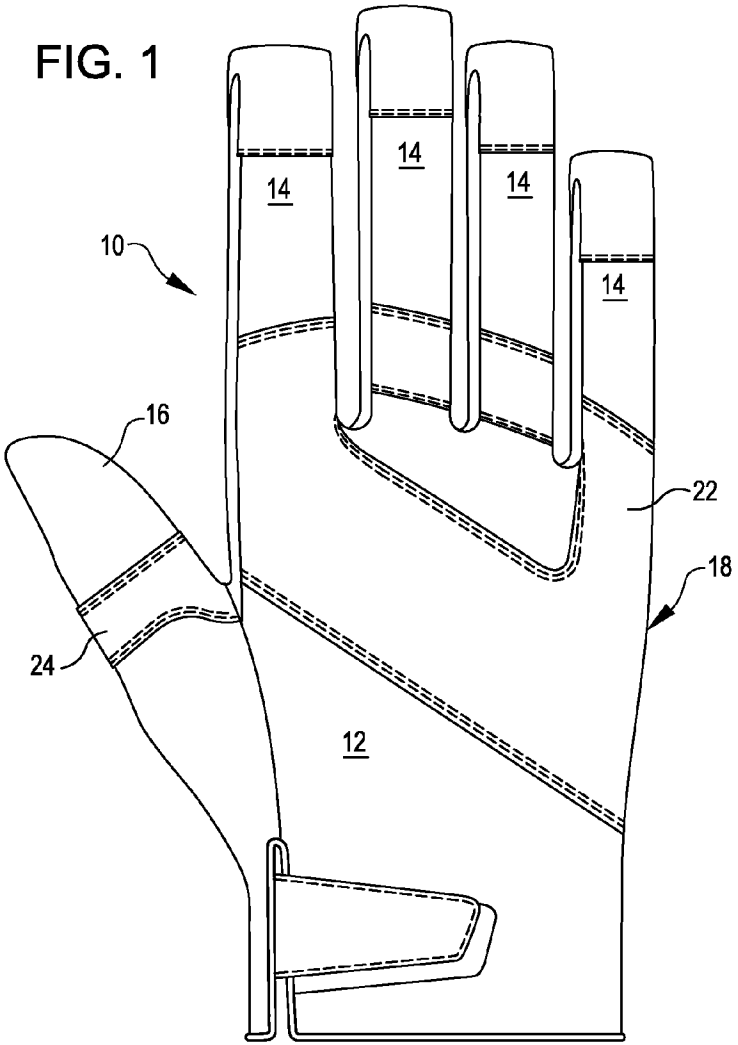
FIG. 1 is a top view of a glove in accordance with embodiments.

Embodiments herein are directed to a glove that is constructed so that fingertips can be cut off without the glove dismantling or fraying. FIG. 1 shows a glove 10 in accordance with embodiments. The glove 10 includes a body 12 with finger sheaths 14 and a thumb sheath 16, which is a finger sheath configured to fit a thumb of a wearer. A backside 18 of the glove 10 is shown in FIG. 1, and a palm-side 20 of the glove is shown in FIG. 2.

A strip 22 of reinforcing material extends across the back 18 of the glove 10. The strip 22 of material is preferably a material that does not unravel or tear easily, such as a non-woven material, e.g., leather, a non-woven fabric, a heavy print, a laminate, and/or some other type of feature or attachment applied to the material forming the back 18 of the glove 10. In the embodiments shown in the drawings, the strip 22 includes a thumb portion 24 that extends over part of the thumb.

The strip 22 and the thumb portion 24 extend up a portion of each of the finger sheaths 14 and over a portion of the thumb sheath 16. In embodiments, the strip 22 (which may include the thumb portion 24) ends just below where a first joint (closest to palm) of a finger or a thumb that is within the sheath would be located. The strip 22 can extend toward the wrist as far as desired, but in an embodiment extends down to cover at least a portion of the back of the hand. The strip 22 shown in the drawings extends across all the fingers, including the thumb, but could extend across any subset of these.

Figure 4:
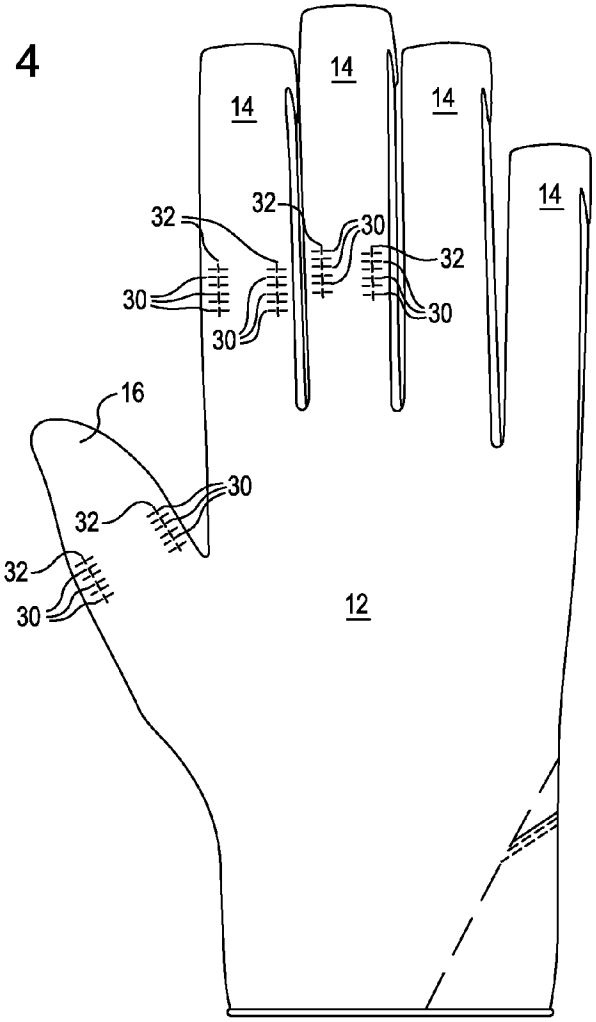
FIG. 4 is a rear, palm-side view of the glove of FIG. 1, with the glove inside out.
Figure 3:
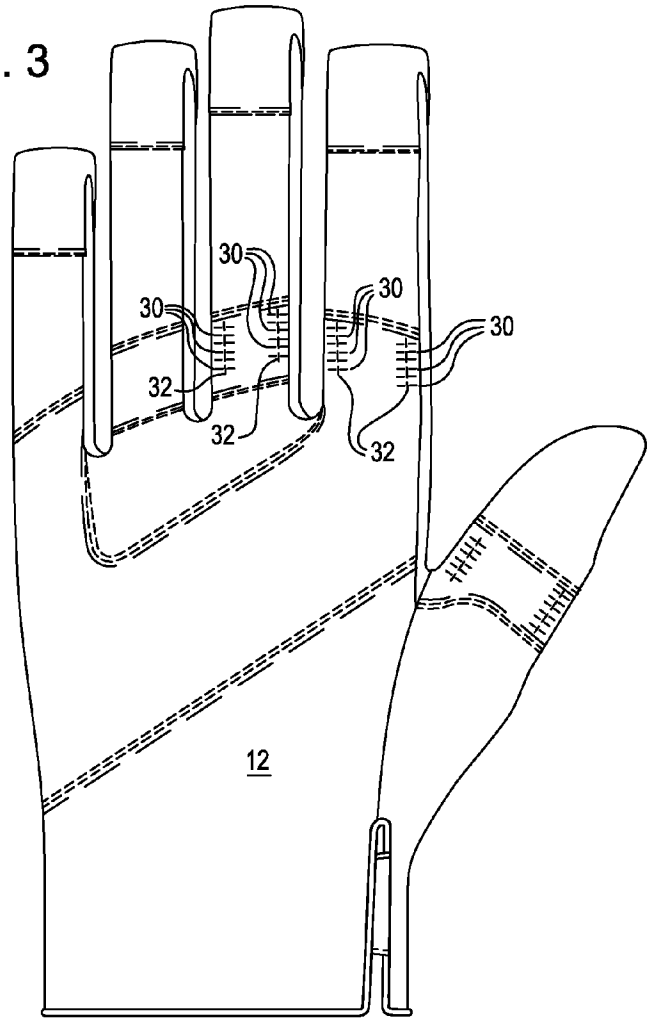
FIG. 3 is a top view of the glove of FIG. 1, with the glove turned inside out.

In addition to the strip 22, the glove 10 includes reinforcement stitching 30 (FIGS. 3 and 4) on the inside of the glove along seam lines. In the embodiments shown in the drawings, the glove finger and thumb sheaths 14, 16, include pieces of fabric that are sewn together along seam lines 32 that extend along the length of the finger sheathes. There can be any number of the seam lines around the perimeter of the finger sheaths, but in embodiments, there are seam lines at four corners so as to form a rectangular cross section for the finger sheaths. As shown in FIGS. 3 and 4, in embodiments, the reinforcement stitching 30 includes a number of perpendicular threads that extend across these seam lines 32. In this manner, when a glove is cut, the stitching for the sheaths 14, 16 does not unravel because the seam 32 is held together by the next adjacent reinforcement stitching 30. Said another way, when a portion of the sheath 14, 16 on the distal side of the reinforcement stitching 30 is removed, the reinforcement stitching 30 prevents unraveling of the seam 32 on the proximate side of the reinforced stitching 30. The seam lines can be, for example, a single needle tack stitch 32, and the reinforcement stitching 30 can be a series of threads that are sewn in perpendicular to this single needle tack stitch. Although the single needle tack stitch and the reinforced stitch are disclosed as one way of assembling the glove and reinforcing the stitching, any type of reinforcement could be used, including glue, other stitched reinforcements, or other structures that would prevent unraveling when a fingertip is cut. In addition, although the reinforcement stitching 32 is described in embodiments as extending perpendicular to the seam lines, when used, the reinforcement stitching can be arranged tranverse to the seam lines at any angle across the seam lines.

In an embodiment, cut lines 40 (FIG. 2) are provided on one or more of the finger sheaths 14 and/or the thumb sheath 16. These cut lines 40 align slightly above the top edges of the strip 22. In this manner, a user wishing to remove portions of the finger sheaths 14 or the thumb sheath 16, can cut along the cut line 40 and will be cutting just above the strip 22. The strip 22 and the reinforced stitching 30 prevent the glove from fraying or falling apart after this cutting has occurred. Thus, a user may utilize the glove with removed fingertips.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A glove, comprising:

a finger sheath comprising multiple pieces of fabric held together by seams; and reinforcements for the seams so that part of the sheath can be removed by cutting without the seams unraveling; wherein the reinforcements for the seams comprise reinforcing stitching across the seams, wherein the reinforcing stitching comprises threads extending substantially perpendicularly across the seams.

2. The glove of claim 1, wherein the finger sheath is a thumb sheath.

3. The glove of claim 1, wherein the reinforcements for the seams includes a strip of reinforcing material extending up at least a portion of the sheath.

4. The glove of claim 3, wherein the strip of reinforcing material comprises leather material.

5. The glove of claim 3, wherein the strip of reinforcing material comprises a nonwoven material.

6. The glove of claim 3, wherein the strip of reinforcing material ends proximate to a position for a first joint of a wearer's finger in the sheath.

7. The glove of claim 6, wherein the strip of reinforcing material extends (i) from proximate to a position for a first joint of a wearer's finger in the sheath, and (ii) toward a cuff of the glove to cover at least a portion of the back of the hand of the glove.

8. The glove of claim 3, wherein the strip of reinforcing material extends across multiple finger sheaths of the glove.

9. The glove of claim 1, wherein the reinforcing stitching is inside the sheath.

10. The glove of claim 1, wherein the seams comprise a single needle tack stitch.

11. The glove of claim 1, wherein the reinforcements for the seams comprises glue.

12. The glove of claim 1, further comprising a cut line disposed on the sheath and indicating a position at which the sheath may be cut for removal of a portion of the sheath without the seams unraveling.

13. A glove comprising:

a finger or thumb sheath comprising multiple pieces of fabric held together by seams formed by one or more first threads; and reinforcing stitching comprising one or more second threads extending substantially perpendicularly across the one or more first threads so that a part of the sheath on the distal side of the reinforcing stitching can be removed without the seams on the proximate side of the reinforcing stitching unraveling.

14. The glove of claim 13, further comprising a strip of reinforcing material extending at least along a portion of a back of the sheath.

15. A method comprising:

providing a glove having a finger sheath comprising multiple pieces of fabric held together by a seam extending along a length of the finger sheath; and reinforcing the glove to prevent unraveling of the seam when a distal portion of the finger sheath is cut for removal, reinforcing the glove comprising at least adding stitching substantially perpendicularly across the seam of the finger sheath.

16. The method of claim 15, wherein reinforcing the glove further comprises:

attaching a reinforcing strip of material along at least a proximate portion of the finger sheath.

17. The method of claim 15, further comprising marking a cutline on the sheath to indicate a position at which the finger sheath can be cut for removal of a portion of the finger sheath distal to the cut without causing the seam to unravel.

* * * * *